US010071386B2

(12) United States Patent
Ukigai et al.

(10) Patent No.: US 10,071,386 B2
(45) Date of Patent: Sep. 11, 2018

(54) SPOUTING APPARATUS

(71) Applicant: TOTO LTD., Kitakyushu-shi, Fukuoka (JP)

(72) Inventors: Kiyotake Ukigai, Kitakyushu (JP); Katsuya Nagata, Kitakyushu (JP); Masateru Miyazaki, Kitakyushu (JP); Yutaka Aihara, Kitakyushu (JP); Shuhei Hayata, Kitakyushu (JP); Kei Watanabe, Kitakyushu (JP); Nao Tanizaki, Kitakyushu (JP); Hiroshi Nishijima, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 15/377,611

(22) Filed: Dec. 13, 2016

(65) Prior Publication Data

US 2017/0165688 A1 Jun. 15, 2017

(30) Foreign Application Priority Data

Dec. 15, 2015 (JP) ..... 2015-244198

(51) Int. Cl.
*B05B 1/34* (2006.01)
*B05B 1/18* (2006.01)
(Continued)

(52) U.S. Cl.
CPC ..... *B05B 1/34* (2013.01); *B05B 1/08* (2013.01); *B05B 1/185* (2013.01); *B05B 1/22* (2013.01);
(Continued)

(58) Field of Classification Search
CPC ..... B05B 1/34; B05B 1/22; B05B 15/0291; B05B 1/08; B05B 1/185; E03C 1/0408; E03C 1/04
(Continued)

(56) References Cited

U.S. PATENT DOCUMENTS 4,151,955 A * 5/1979 Stouffer ..... B05B 1/08 137/835
2003/0062426 A1* 4/2003 Gregory ..... B05B 1/185 239/107
(Continued)

FOREIGN PATENT DOCUMENTS

JP S58-49300 B2 11/1983
JP 2000-120141 A 4/2000
(Continued)

*Primary Examiner* — Alexander Valvis
*Assistant Examiner* — Joel Zhou
(74) *Attorney, Agent, or Firm* — Baker & Hostetler LLP

(57) ABSTRACT

To provide a spout apparatus whereby expansion and deformation of the inner wall surface of the vortex generating portion such that a desired Karman vortex cannot be generated are prevented, even when the port portion is formed of an elastically deformable soft member. A spout apparatus for discharging hot or cold water with reciprocal motion, having a spout apparatus body and a vortex generating passage; whereby the oscillating element has a supply passage, a vortex generating passage, and a spout port passage, and the spout port passage is formed by an elastically deformable soft member, and is attached to the spout apparatus body so that a user can manipulate and deform the spout port passage, and the vortex generating passage is formed so as not to expand and deform even if internal pressure rises due to the supply of hot or cold water from the supply passage.

8 Claims, 7 Drawing Sheets

(51) Int. Cl.

| | |
|---|---|
| ***B05B 1/22*** | (2006.01) |
| ***B05B 1/08*** | (2006.01) |
| ***E03C 1/04*** | (2006.01) |
| ***B05B 15/528*** | (2018.01) |

(52) U.S. Cl.
CPC ..... *B05B 1/341* (2013.01); *B05B 15/528* (2018.02); *E03C 1/04* (2013.01); *E03C 1/0408* (2013.01)

(58) Field of Classification Search
USPC .... 239/589.1, 589, 383, 381, 382, 444, 562, 239/525, 101, 518, 590, 548
See application file for complete search history.

(56) References Cited

U.S. PATENT DOCUMENTS

| | | | | |
|---|---|---|---|---|
| 2010/0072307 | A1* | 3/2010 | Hester | B05B 1/08 239/589.1 |
| 2011/0108640 | A1* | 5/2011 | Grohe | B05B 1/08 239/548 |
| 2011/0233301 | A1* | 9/2011 | Gopalan | B05B 1/08 239/101 |
| 2012/0266376 | A1* | 10/2012 | Marty | B05B 1/185 4/615 |

FOREIGN PATENT DOCUMENTS

| | | | |
|---|---|---|---|
| JP | 2004-275985 | A | 10/2004 |
| TW | 457985 | U | 10/2001 |
| WO | 79-00236 | A1 | 5/1979 |

* cited by examiner without water with water with water

SPOUTING APPARATUS

TECHNICAL FIELD

The present invention pertains to a spouting apparatus for discharging hot or cold water while causing it to reciprocally oscillate.

BACKGROUND ART

Patent Documents 1-3 below set forth a spouting apparatus utilizing an oscillating phenomenon based on a fluid device. In such spout apparatuses, the spout water spray direction can be changed without providing a movable member, thus affording the advantage that a spout apparatus capable of spouting over a wide range can be achieved using a simple and compact constitution.

In the spout apparatus set forth in Patent Document 3 below, as shown in FIG. 13, a fluid which has flowed into a antechamber 110 from an intake hole 114 first collides with an obstacle 116 having a triangular cross section, and disposed as an island within the antechamber 110. When the fluid collides, Karman vortices are alternately formed on the upper and lower sides of the obstacle 116, resulting in a vortex street. This Karman vortex street reaches the outlet 112 as it grows. Close to the outlet 112, the flow velocity on the side where the vortex street is present speeds up, and the flow velocity on the opposite side thereto slows down. In the example shown in FIG. 13, the Karman vortices occur alternately on the upper and lower sides of the obstacle 116; these vortex streets sequentially reach the outlet 112, thereby alternately producing a high flow velocity on the upper side and a high flow velocity on the lower side. In the high flow velocity state on the upper side, the high speed fluid collides with a wall surface 110*a* on the upper side of the outlet 112 and is changed, while the fluid sprayed from the outlet 112 forms a spray flow which as a whole is directed diagonally downward. In the high flow velocity state on the lower side, on the other hand, the high flow velocity fluid collides with a wall surface 110*b* on the lower side of the outlet 112, and a spray flow is sprayed diagonally upward from the outlet 112. Alternating repetition of such states results in the spray flow from the outlet 112 being sprayed as it oscillates in a reciprocating manner. Using a spout apparatus of this type, a spout apparatus can be achieved which is capable of spraying over a broad range while being extremely simple and compact.

PRIOR ART DOCUMENTS

Patent Documents

Patent Document 1: JP 2000-120141 A
Patent Document 2: JP 2004-275985 A
Patent Document 3: JP S58-49300 B

SUMMARY OF THE INVENTION

Problems the Invention Seeks to Resolve

However, when the spout apparatus set forth in Patent Document 3 is used over a long period in a region where there is high calcium content in the municipal water, the calcium component hardens on interior wall surfaces and the resulting scale adheres thereto. When scale adheres in this way to the inner wall surface of the spout port, the oscillation amplitude and oscillation frequency, etc. of the spout water changes, resulting in the problem that the desired spouting cannot be achieved. This scale is difficult to remove by force of water flow alone, but it is possible to remove by physical scraping, or by deforming the wall surface itself to which the scale is adhered. It is therefore preferable to form the spout port portion of an elastically deformable soft member, and to attach it to the spout apparatus body so that a user can manipulate and deform the spout port passage.

However when forming a spout port portion of an elastically deformable soft member, a new problem arises when, for example, even the Karman vortex generating portion is integrally formed of a soft member.

Specifically, when the vortex generating portion is formed by a soft member, the rise in internal pressure when water is supplied to the vortex generating portion leads to a risk of expansion deformation of the inner wall surface of the vortex generating portion. In a spout apparatus of this type, a desired vortex is produced by designing the gap between the flow path obstacle and the surrounding inner wall surface with a specified dimension. Therefore when the inner wall surface of the vortex generating portion expands and distorts, the above gap dimensions widen (cease to have the specified dimension), resulting in the risk that the desired vortex may not be produced. When this desired vortex ceases to occur, the spout water oscillation amplitude and amplitude frequency also change, leading to the problem that a desired spout water cannot be performed in the house.

The present invention was undertaken in light of these problems, and has the object, in a fluid device using Karman vortices, of providing a spout apparatus capable of preventing the vortex generating portion from expanding and deforming so that the desired Karman vortex cannot be produced, even when the spout port portion is formed of an elastically deformable soft member.

Means for Resolving Problem

To solve the problems above, the spout apparatus of the present invention has a spout apparatus body, and an oscillating element attached to this spout apparatus body for discharging supplied hot or cold water while causing it to reciprocally oscillate. In addition, the oscillating element above has: a supply passage into which hot or cold water supplied from the spout apparatus body flows; a vortex generating passage, disposed on the downstream side of this supply passage and having a hot or cold water colliding portion placed so as to close off a portion of the flow path cross section, for generating vortices in alternating opposing directions on the downstream side thereof by the collision of a portion of the hot or cold water guided from the supply passage with this hot or cold water colliding portion; and a spout port passage, disposed on the downstream side of the vortex generating passage, for spouting hot or cold water containing vortex streets guided from the vortex street passage, while causing same to reciprocally oscillate. In addition, the spout port passage is formed by a soft member capable of elastic deformation, and is attached to the spout apparatus body so that a user can manipulate the spout port passage to deform it. Furthermore, the vortex generating passage is formed so as not expand and deform, even when internal pressure is raised by the supply of hot or cold water from the water supply passage.

In the invention thus constituted, hot or cold water discharged from a spout apparatus can be reciprocally oscillated using an oscillating element, therefore hot or cold water can be discharged over a wide range from a single spout port using a compact and simple structure. Also, the spouting direction can be changed without moving the discharge nozzle, therefore no problems such as wear of the movable portions occur, and a low cost, high durability spout apparatus can be provided. A user can easily remove scale adhering to the inner wall surface of the spout passage by manipulating the spout passage to deform it. In addition, by constituting the invention so that the vortex generating passage does not expand and deform, a specified dimension between an obstacle and its surrounding inside wall surfaces can be maintained even if water is supplied to the oscillating elements and the internal pressure in the vortex generating passage rises. Thus according to the present invention, an occurrence whereby the inside wall surface of the vortex generating portion expands and deforms such that the desired Karman vortex cannot be produced is prevented, even if the spout port portion is formed of an elastically deformable soft member.

In a spout apparatus according to the present invention, it is preferable for the vortex generating passage to be integrally formed of an elastically deformable soft member with the spout port passage, and for a deformation limiting portion for limiting the expansion deformation of the vortex generating passage to be disposed on the outer circumferential portion of the vortex generating passage.

In the invention thus constituted, when deformation of the spout port passage reaches the vortex generating passage, scale adhered to the vortex generating passage (including the obstacles and surrounding inside wall surfaces which exert a significant effect on oscillation spouting), which is difficult for a user to reach, can be removed. In addition, by manipulating and deforming the spout port passage, scale adhered to the spout port passage and scale adhere to the vortex generating passage can be simultaneously removed in a single operation by deforming the spout port passage and the vortex generating passage. By providing a deformation limiting portion, the specified dimension between the obstacle and its surrounding inside wall surfaces can be maintained, even when the vortex generating passage is formed by a soft member.

Also, in the spout apparatus pertaining to the present invention, the deformation limiting portion is preferably formed so that the vortex generating passage wall thickness is greater than that of the spout port passage.

In the invention thus constituted, by increasing the wall thickness of the vortex generating passage, the gap between the obstacle and the surrounding inside wall surfaces can be maintained at a specified dimension even if the vortex generating passage is formed by a soft member.

In the spout port passage of the present invention, the deformation limiting portion is preferably formed so that the pressure of hot or cold water flowing in the supply passage is applied to the outer wall surface of the vortex generating passage.

In the invention thus constituted, by applying the pressure of hot or cold water flowing in the supply passage to the outer wall surface of the vortex generating passage, pressure is applied to the vortex generating passage in opposite directions, from the inside and the outside. Thus the specified dimension between the obstacle and its surrounding inside wall surfaces can be maintained even when the vortex generating passage is formed by a soft member.

In the spout apparatus of the present invention, the deformation limiting portion is preferably a deformation limiting member formed separately from the spout port passage.

In the invention thus constituted, by providing a deformation limiting member formed separately from the spout port passage a specified dimension between the obstacle and the surrounding inner wall surfaces can be maintained even when the vortex generating passage is formed by a soft member.

Also, in the invention thus constituted it is preferable for the deformation limiting member to be disposed so that a tiny gap is formed relative to the vortex generating passage outer wall surface in a state whereby supply of hot or cold water from the supply passage to the vortex generating passage is stopped.

In the invention thus constituted, when the deformation limiting member is attached to the outer circumferential portion of the vortex generating passage, it prevents compressive deformation of the vortex generating passage. Thus the specified dimension between the obstacle and its surrounding inside wall surfaces can be maintained even when the vortex generating passage is formed by a soft member.

Also, in the invention thus constituted it is preferable for the deformation limiting member to be disposed to contact the vortex generating passage outer wall surface in a state whereby hot or cold water is being supplied from the supply passage to the vortex generating passage.

In the invention thus constituted, when water is supplied to the oscillating elements and the internal pressure in the vortex generating passage rises notwithstanding the provision of a tiny gap, expansion deformation is limited by contact of the vortex generating passage outer wall surface with the deformation limiting member, so a specified dimension can be maintained between the obstacle and its surrounding inner wall surfaces.

Effect of the Invention

The present invention, in a fluid device utilizing Karman vortices, provides a spout apparatus capable of preventing expansion deformation of the vortex generating portion inner wall surface in such a way that a desired Karman vortex cannot be produced, even if the spout port portion is formed of an elastically deformable soft member.

EMBODIMENTS OF THE INVENTION

Figure 1:
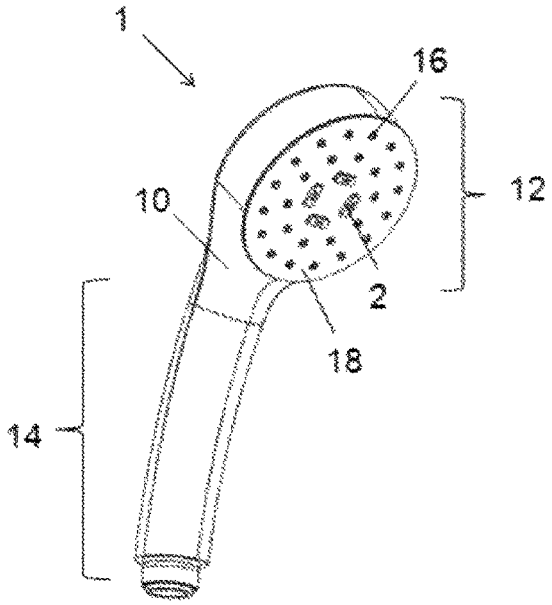
FIG. 1: An exterior view of a spout apparatus 1 in the present invention.

Below, referring to figures, we explain the spout apparatus 1 in an embodiment of the present invention. FIG. 1 is an external view of the spout apparatus 1 of the present invention. The spout apparatus 1 is what is known as a hand shower, and is made up of a spout apparatus body 10 and oscillating elements 2 disposed on the spout apparatus body 10. The spout apparatus body 10 broadly comprises a spout head 12 and a holding portion 14. Two types of spout ports consisting of multiple spout nozzles 16 and oscillating elements 2 are disposed on the spout head 10; spouting can occur simultaneously in each of these, or spouting can be achieved by switching successively between them.

Figure 2:
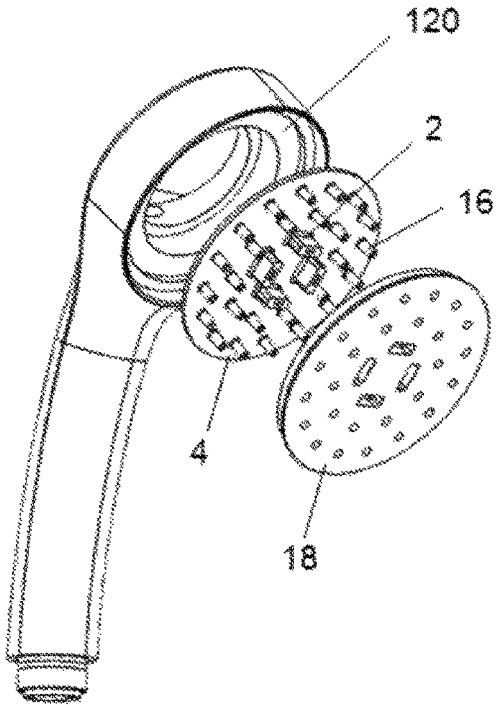
FIG. 2: An exploded perspective view of the spout apparatus 1 in the present invention.

FIG. 2 is an exploded perspective view of the spout apparatus 1 in the present invention. The spout head 12 is composed of a sprinkler packing 4 comprising a soft member having a sprinkler plate 18 disposed on its surface, oscillating elements 2, and spout nozzles 16. Multiple opening portions are disposed on the sprinkler plate 18; from these opening portions, the oscillating element 2 and spout nozzles 16 are assembled in a form projecting on the surface.

Figure 3:
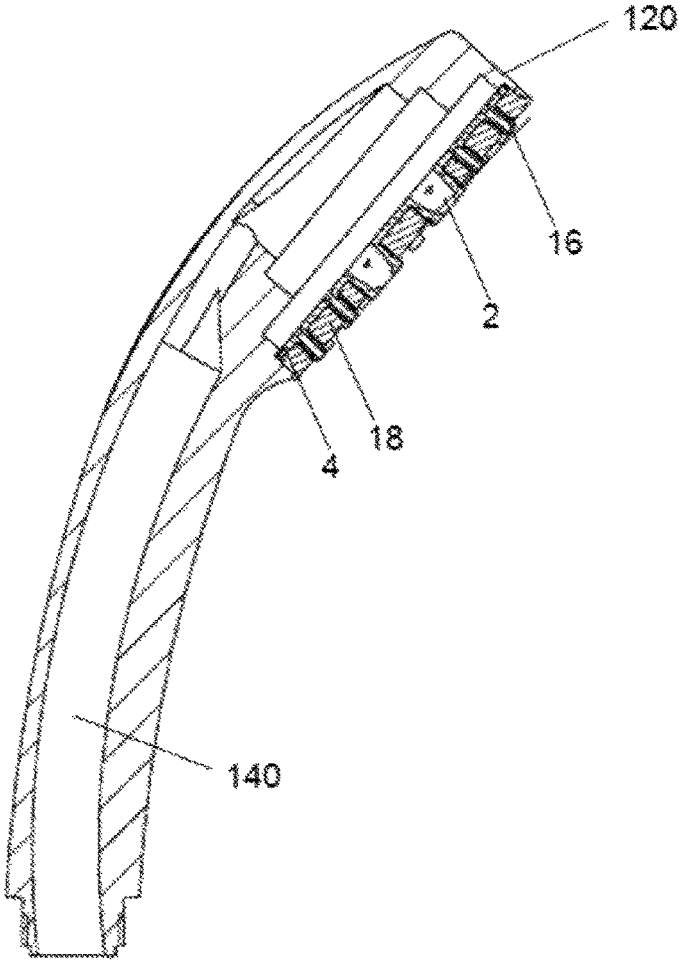
FIG. 3: A cross section of the spout apparatus 1 in the present invention.

FIG. 3 is a cross section of the spout apparatus 1 in the present invention. As shown in FIG. 3, the sprinkler packing 4 is affixed so as to be sandwiched between a spout head body 120 and the sprinkler plate 18. A water supply path 140 is formed inside the holding portion 14, and hot or cold water supplied from a shower hose, not shown, is supplied to the spout head 12.

Figure 4:
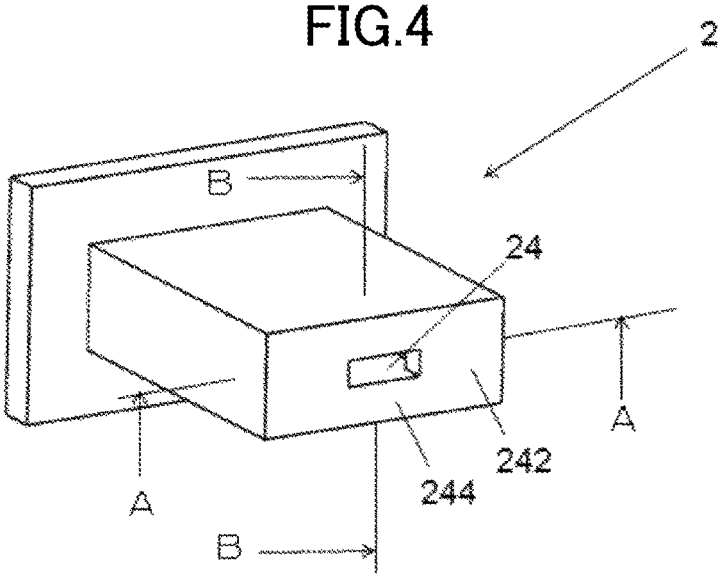
FIG. 4: An exterior view of an oscillating element 2 in the present invention.

FIG. 4 is an external view of the oscillating element 2 in the present invention. The oscillating element 2 has an approximately rectangular spout port, and is a nozzle for spouting water while reciprocally oscillating in the longitudinal direction of that rectangle. There are respectively a pair of first wall surface portions 242 on the long sides matching the direction in which hot or cold water reciprocally oscillates, and a pair of second wall surface portions 244 on the short sides perpendicular thereto, and the first wall surface portions 242 are thicker than the second wall surface portions 244.

Figure 5A:
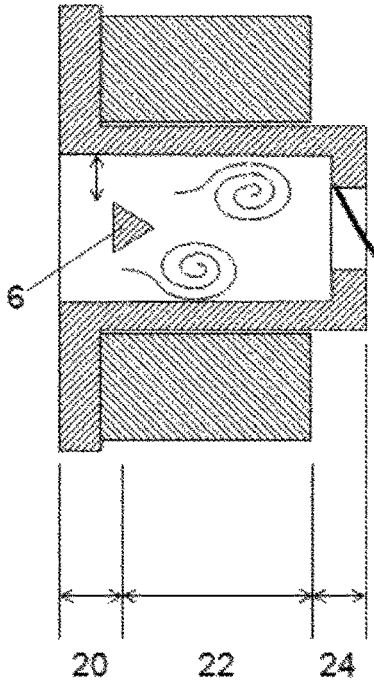
FIG. 5A: A schematic showing the oscillation of spout water in the present invention.
Figure 5B:
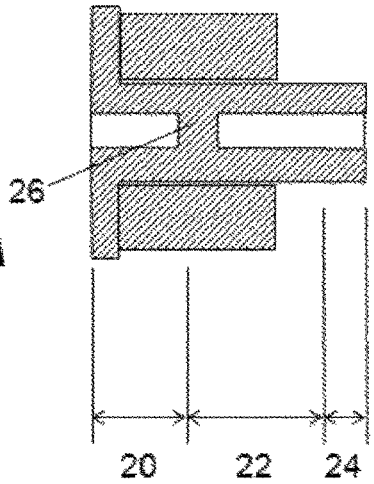
FIG. 5B: A schematic showing the oscillation of spout water in the present invention.

FIGS. 5A and 5B are a schematic diagram showing the appearance of an operating oscillating element 2 in the main unit. FIG. 5A is a cross section through A-A in FIG. 4, but as shown here, a passage with a rectangular cross section is formed inside the oscillating element 2 so as to penetrate in the long direction. This passage is formed as a water supply passage 20, a vortex generating path 22, and a spout port passage 26 in that sequence from the upstream side of this path. The water supply passage 20 is a straight passage with a constant rectangular cross section extending from the inflow port on the rear side of the oscillating elements 2.

The vortex generating path 22 is a passage with a rectangular cross section disposed so as to connect with the water supply passage 20 (without level differences) at the downstream side of the water supply passage 20. I.e., it has the same dimensions and shape from the water supply passage 20 to the vortex generating path 22. The spout port passage 24 is a rectangular cross section passage disposed to connect with the vortex generating path 22 still further downstream of the vortex generating path 22. The spout port passage 24 is comprised so that its length in the direction of the long side of the cross sectional rectangle is shorter than the vortex generating path 22, and its cross section is small.

A hot or cold water collision portion 26 is disposed between the water supply passage 20 and the vortex generating path 22. This hot or cold water collision portion 26, as shown in FIG. 5B (a cross section through B-B in FIG. 4), is a triangle-shaped part extending to join with the wall surfaces (the ceiling surface and floor surface) opposing one another in the height direction of the water supply passage 20, and is disposed as an island at the center in the width direction of the water supply passage 20. The cross section of the hot or cold water collision portion 26 is formed as an isosceles triangle, wherein the two equal length sides are disposed to face downstream. By disposing this hot or cold water collision portion 26, a Karman vortex is formed within the vortex generating path 22, and hot or cold water spouted from the hot or cold water collision portion 26 reciprocally oscillates.

Note that of the hot or cold water collision portion 26, the surface area of the surface on which hot or cold water flowing from the water supply passage 20 collides, i.e., the flow path cross sectional area in the part of the water supply passage 20 blocked off by the hot or cold water collision portion 26, is constituted to be larger than the flow path cross sectional area of the spout port passage 24.

Figure 6:
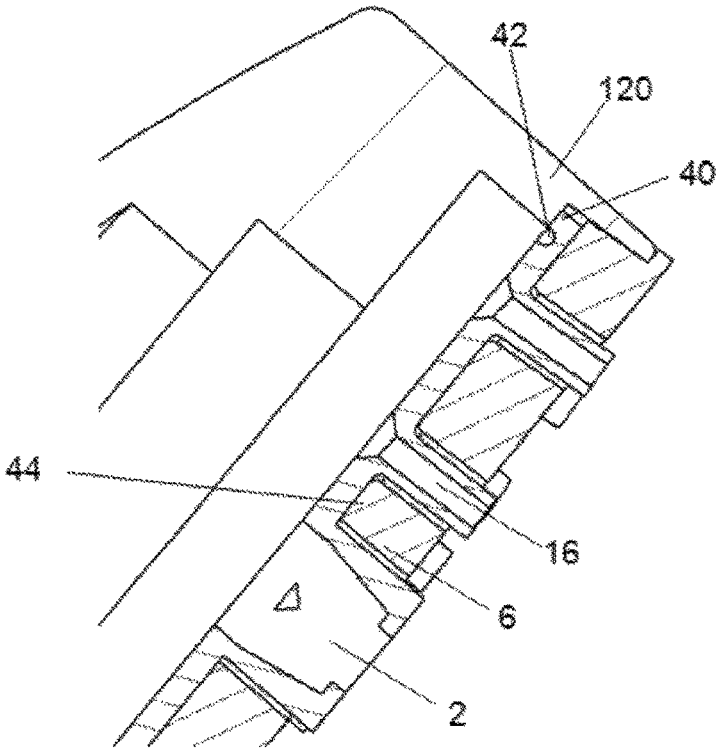
FIG. 6: An expanded cross section close to the seal portion 40 in the present invention.

FIG. 6 shows an expanded cross section of the spout head 12. As described earlier, the sprinkler packing 4 is affixed so as to be sandwiched between the spout head body 120 and the sprinkler plate 18. At this point, the sprinkler packing 4 also serves as a seal member for sealing between the spout head body 120 and the sprinkler plate 18, and has a seal portion 40 for making a watertight seal between the two. By being pressed by both elements, the seal portion 40 serves as a structure for assuring watertightness.

Left alone, deformation caused by pressing causes the entire soft sprinkler packing 4 to spread out, such that the oscillating elements 2 and the spout nozzles 16 also distort, affecting spouting. To inhibit this, a deformation limiting portion 42 is disposed close to the seal portion 40. By this deformation limiting portion 42, distortion of the seal portion 40 is cut off further upstream than the oscillating element 2, so that distortion of the oscillating elements 2 or the spout nozzles 16 is suppressed, and aesthetic spouting is maintained.

A part of the sprinkler packing 4 is disposed with a tiny gap as a deformation limiting member 6 in the vicinity of the oscillating elements 2. As described below, this deformation limiting member 6 is provided to suppress expanding of the oscillating elements 2 caused by water pressure. Note that damage to the oscillating elements 2 through contact with the deformation limiting member 6 when the spout apparatus 1 is assembled can be suppressed by forming a tiny gap between the deformation limiting member 6 and the oscillating elements 2.

Figure 7A:
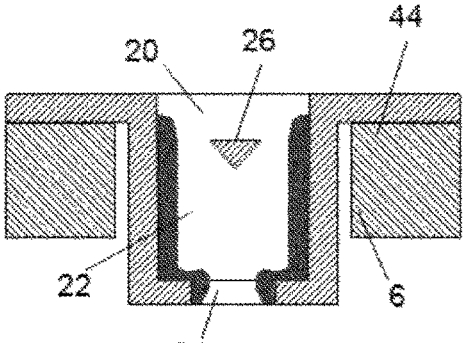
FIG. 7A: A schematic showing scale removal in the present invention.

Next we explain the arrangement for removing scale in the present invention, referring to the FIGS. 7A-7D schematic. Scale occurs when silica or calcium contained in municipal water is gradually deposited on the wall surface of a water conduit. In the spout apparatus 1, as shown in FIG. 7A, there is gradual deposit and accumulation on the spout nozzles 16, the water supply passage 20, the vortex generating path 22, the spout port passage 24, and so forth. When scale adheres and deposits at such locations, it affects the generation of Karman vortices and spouting, so there is a potential that spout water oscillation or spouting itself will distort.

Figure 7B:
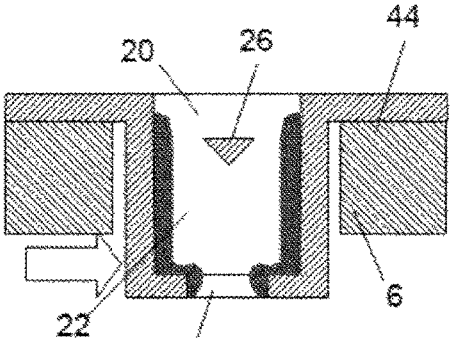
FIG. 7B: A schematic showing scale removal in the present invention.
Figure 7C:
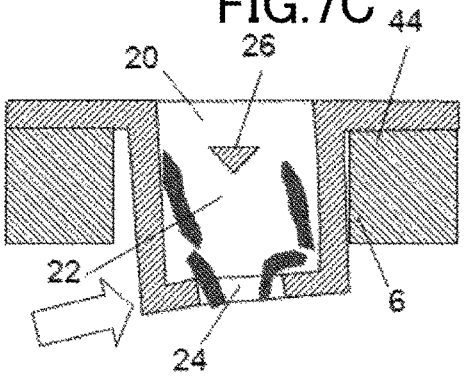
FIG. 7C: A schematic showing scale removal in the present invention.
Figure 7D:
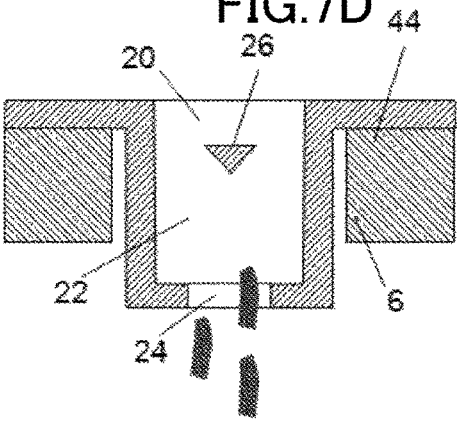
FIG. 7D: A schematic showing scale removal in the present invention.

At this point, pressure is applied by a finger or the like from the side surface of the spout port passage 24 projecting on the surface of the sprinkler plate 18, as shown in FIG. 7B. When this happens, as shown in FIG. 7C, deformation of the spout port passage 24 is transmitted to the water supply passage 20, and scale falls off due to the respective deformations. When water is spouted in this state, as shown in FIG. 7D, the fallen scale is flushed out and removed from the oscillating element 2.

Figure 8:
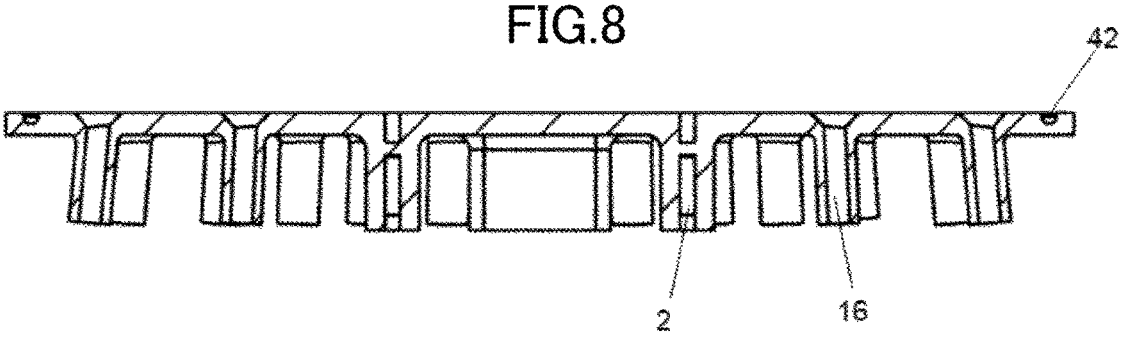
FIG. 8: A cross section of the shower nozzle 16 in the present invention.

As shown in FIG. 8, the oscillating element 2 comprises a soft member as the sprinkler packing 4 in an integrated piece with the spout nozzles 16, the seal portion 40, etc. Thus multiple functions such as sealing between the sprinkler plate 18 and the spout head body 120 can be given to a single member without transferring the deformation of the oscillating element 2 spout port passage 24 to the vortex generating path 22, and without providing separate seal members.

Figure 9:
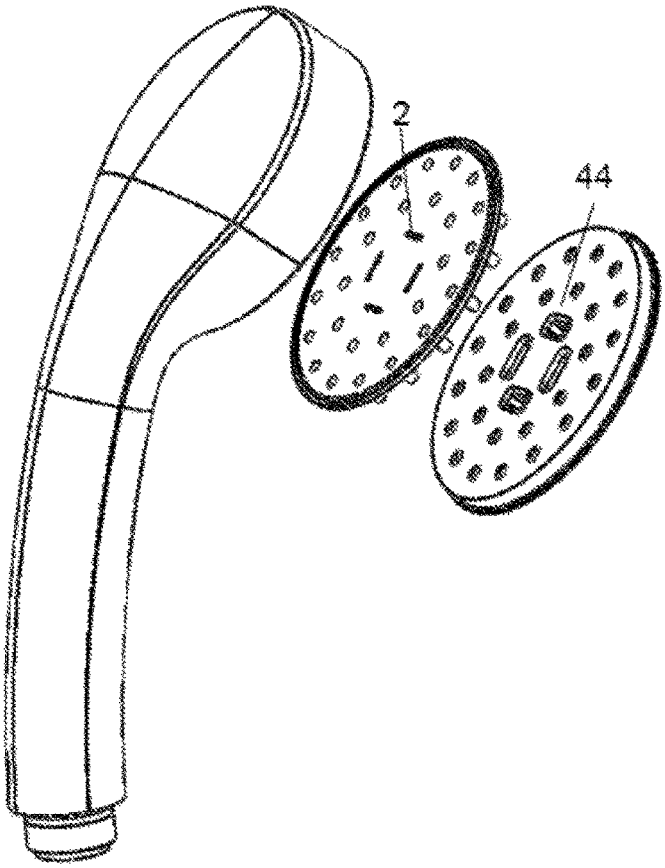
FIG. 9: An exploded perspective view seen from the rear side of the spout apparatus 1 in the present invention.

As shown in FIG. 9, multiple oscillating elements 2 are disposed on the sprinkler packing 4. At this point, the sprinkler packing 4 and the reverse surface of the sprinkler plate 18 make contact around the respective oscillating elements 2 and act as an affixing portion. Thus when force is applied such that an oscillating element 2 spout port passage 24 deforms, the locations reached by the deformation are limited to the area surrounding each of the oscillating elements 2. Stated different, the force applied to the spout port passage 24 can be utilized to distort each of the oscillating elements 2 so that scale can be efficiently removed. If affixing portions are not provided in this way, force is absorbed by the deformation of the entire sprinkler packing 4, and there is a possibility that the vortex generating path 22 will not deform well, and scale will not be fully removed.

Figure 10A:
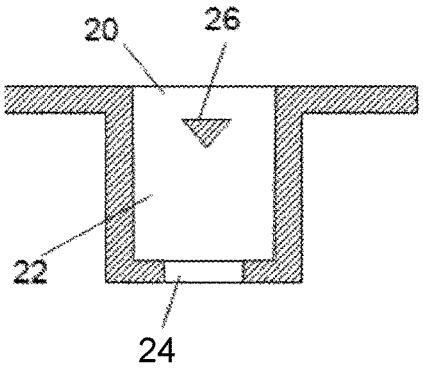
FIG. 10A: A schematic of the appearance when water pressure is applied to the oscillating element 2 in a comparative example.
Figure 10B:
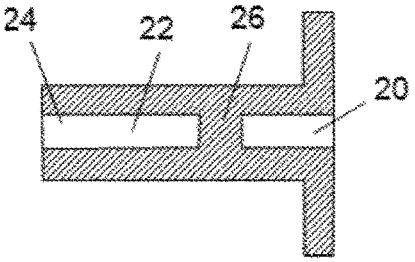
FIG. 10B: A schematic of the appearance when water pressure is applied to the oscillating element 2 in a comparative example.
Figure 10C:
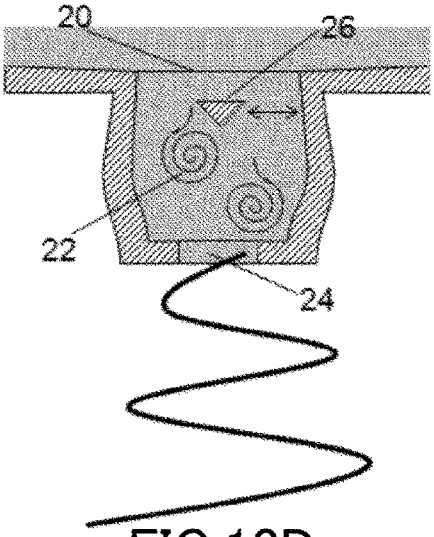
FIG. 10C: A schematic of the appearance when water pressure is applied to the oscillating element 2 in a comparative example.
Figure 10D:
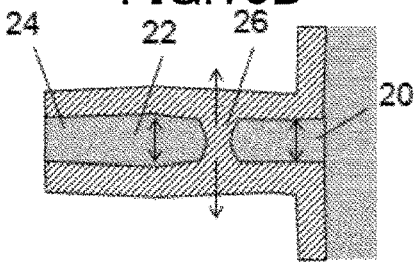
FIG. 10D: A schematic of the appearance when water pressure is applied to the oscillating element 2 in a comparative example.

FIGS. 10A-10D schematically show the appearance when water pressure is applied to the oscillating elements 2 in a comparative example. In this comparative example there is no deformation limiting member 6 provided, in contrast to the invention embodiment. When no water pressure is applied, no deformation occurs, as shown in FIGS. 10A and 10B. When a certain water pressure or greater is applied, however, then as shown in FIGS. 10C and 10D, the oscillating elements 2 composed of a soft material distort greatly to the outside due to the water pressure on the vortex generating path 22 and the like. Because oscillation of spout water in the oscillating elements 2 varies depending on the size of the Karman vortex generated in the vortex generating path 22, large changes of this part lead to a risk that spouting may not occur as planned. Also, since there is also spreading in the height direction, as shown in FIG. 10D, there is a risk that the hot or cold water collision portion 26 will be greatly pulled in the long direction, ultimately breaking.

Figure 11A:
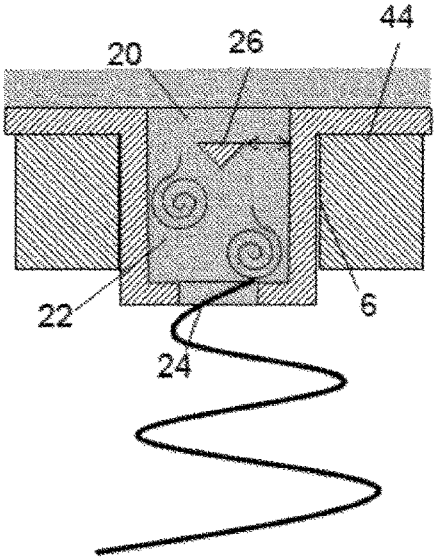
FIG. 11A: A schematic of the appearance when water pressure is applied to the oscillating element 2 in an embodiment of the present invention.
Figure 11B:
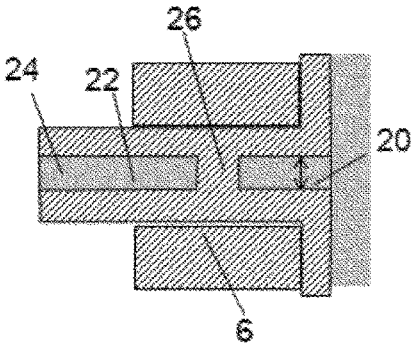
FIG. 11B: A schematic of the appearance when water pressure is applied to the oscillating element 2 in an embodiment of the present invention.

In comparison, FIGS. 11A and 11B schematically show the appearance when water pressure is applied to the oscillating elements 2 in an embodiment of the invention. In the embodiment, a deformation limiting member 6 is disposed close to the oscillating elements 2. By this means, expanding of the oscillating elements 2 can be suppressed by the deformation limiting member 6 even when water pressure is applied to the oscillating elements 2 composed of a soft material. In other words, specified dimensions for the oscillating elements 2 can be maintained even when significant water pressure is acting thereon.

Figure 12A:
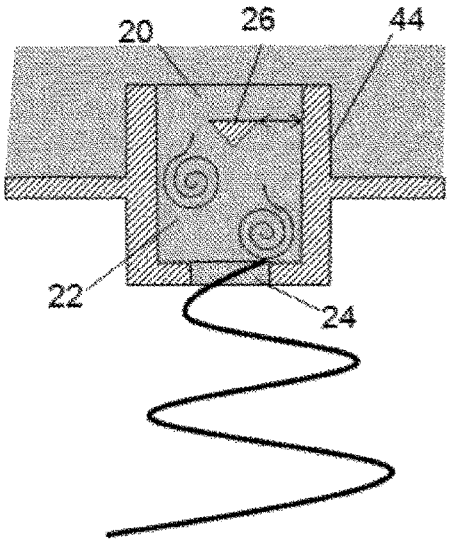
FIG. 12A: A schematic of the appearance when water pressure is applied to the oscillating element 2 in a variant example of the present invention.
Figure 12B:
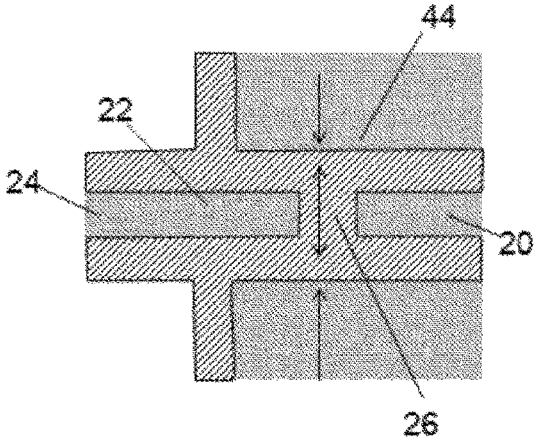
FIG. 12B: A schematic of the appearance when water pressure is applied to the oscillating element 2 in a variant example of the present invention.
Figure 13:
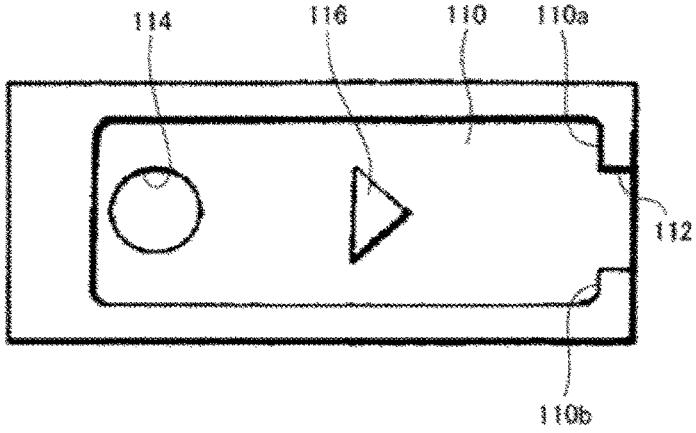
FIG. 13: A diagram showing the constitution of the fluid device set forth in Patent Document 3.

FIGS. 12A and 12B show a oscillating elements 2 in a variant example of the invention. In this variant example, because expanding of the oscillating elements 2 under the action of water pressure is suppressed, a water pressure action portion 60 is provided in place of the deformation limiting member of the embodiment. By placing this water pressure action portion around the side surfaces of the vortex generating path 22, the water pressure acting in a direction which spreads the vortex generating path 22 from inside balances the water pressure acting to shrink the vortex generating path 22 from the outside, with the result that expanding of the oscillating elements 2 can be suppressed.

In the embodiment of the present invention, as in the variant example, the oscillating elements 2 are constituted by a soft material so as to suppress the expanding of the oscillating elements 2; scale can be removed and specified dimensions can be maintained even when a high water pressure acts upon the oscillating elements, so that spouting can be maintained and the durability of the oscillating elements 2 can be improved.

Note that in the spout port passage 24, as shown in FIG. 4, the long direction second wall surface portions 244 are thicker than the short direction first wall surface portions 242. By making thicker long direction first wall surface portions 242 on which oscillating kinetic energy acts in addition to water pressure, the durability of the first wall surface portions 242, which contribute to formation of the oscillation, can be improved, and the occurrence of cracks and the like can be suppressed. Also, deformation of the first wall surface portions 242 can be suppressed and oscillating spouting at a desired amplitude can be accomplished, even when a high water pressure is imparted to the spout port passage 24. On the other hand the second wall surface portions 244 may have a thin constitution; i.e., they may be formed to deform easily. Thus deformation can be accomplished by deforming with a light force even when removing scale by deforming with a finger or the like.

The above completes an explanation of the present invention with reference to an embodiment. The present invention is not limited to the embodiment above, and may be designed as appropriate within the scope of the invention. For example, an oscillating element alone may be used as the type of water spouting, or three or four types may be combined and used. Also, the vortex generating passage may be formed by a hard material and integrally formed with the spout port passage.

EXPLANATION OF REFERENCE NUMERALS spout apparatus: 1
spout apparatus body: 10
spout head: 12
spout head body: 120
holding portion: 14
water supply path: 140
spout nozzle: 16
sprinkler plate: 18
oscillating elements: 2
water supply passage: 20
vortex generating path: 22
spout port passage: 24
first wall surface portions: 242
second wall surface portions: 244
hot or cold water collision portion: 26
sprinkler packing: 4
seal portion: 40
deformation limiting portion: 42
affixing portion: 44
deformation limiting member: 6
water pressure action portion: 60

The invention claimed is:

1. A spout apparatus for discharging hot or cold water with reciprocal motion, comprising:

a spout apparatus body; and an oscillating element, attached to the spout apparatus body, for discharging supplied hot or cold water with reciprocal motion;

wherein the oscillating element comprises:

a water supply passage into which hot or cold water supplied from the spout apparatus body flows;

a vortex generating passage, disposed downstream of the water supply passage, including a hot or cold water collision portion arrayed to block a portion of a flow path cross section, whereby the collision of a portion of hot or cold water guided from the water supply passage to the hot or cold water collision portion alternately produces oppositely circulating vortexes on the downstream thereof; and a spout port passage disposed on the downstream side of the vortex generating passage, for discharging hot or cold water guided from the vortex generating passage with reciprocal motion;

wherein the spout port passage is formed of an elastically deformable soft material, and is attached to the spout apparatus body so that a user can manipulate and deform the spout port passage;

wherein the vortex generating passage is formed so as not expand and deform, even when internal pressure is raised by the supply of hot or cold water from the water supply passage; and wherein a deformation limiting portion for limiting the elastic deformation of the vortex generating passage is disposed on an outer circumferential portion of the vortex generating passage.

2. The spout apparatus of claim 1, wherein the vortex generating passage is integrally formed of the elastically deformable soft material with the spout port passage.

3. The spout apparatus of claim 2, wherein the deformation limiting portion is formed so that the vortex generating passage has a greater wall thickness than the spout port passage.

4. The spout apparatus of claim 2, wherein the deformation limiting portion is formed so that a pressure of hot or cold water flowing in the water supply passage is applied to an outer wall surface of the vortex generating passage.

5. The spout apparatus of claim 2, wherein the deformation limiting portion comprises a deformation limiting member formed as a separate body from the spout port passage.

6. The spout apparatus of claim 5, wherein the deformation limiting member is disposed so that when the supply of hot or cold water from the water supply passage to the vortex generating passage is stopped, a tiny gap is formed relative to the outer wall surface of the vortex generating passage.

7. The spout apparatus of claim 6, wherein the deformation limiting member is disposed so that when hot or cold water is supplied from the water supply passage to the vortex generating passage, the deformation limiting member contacts the outer wall surface of the vortex generating passage.

8. The spout apparatus of claim 1, wherein the vortex generating passage is formed by a hard material.

* * * * *